United States Patent [19]

Fennekels et al.

[11] Patent Number: 4,713,531

[45] Date of Patent: Dec. 15, 1987

[54] HEATING ELEMENT FOR TEXTILES

[75] Inventors: Peter Fennekels; Ernst Waltmann, both of Krefeld; Walter Schumacher, Nettetal, all of Fed. Rep. of Germany

[73] Assignee: Girmes-Werke AG, Fed. Rep. of Germany

[21] Appl. No.: 635,427

[22] Filed: Jul. 30, 1984

[51] Int. Cl.[4] ..... H05B 3/34; H01C 3/06

[52] U.S. Cl. ..... 219/545; 219/211; 219/212; 219/528; 219/529; 219/543; 219/548; 219/549; 338/208; 338/210; 338/215; 338/212; 338/306

[58] Field of Search ..... 219/211, 212, 528, 529, 219/543, 545, 548, 549; 338/206, 207, 208, 210, 211, 212, 214, 306, 31 MY

[56] References Cited

U.S. PATENT DOCUMENTS

| | | | |
|---|---|---|---|
| 1,036,632 | 8/1912 | Johr | 219/545 X |
| 1,872,581 | 8/1932 | Haroldson | 338/208 X |
| 2,884,509 | 4/1959 | Heath | 338/208 |
| 2,922,867 | 1/1960 | Crump | 219/545 X |
| 2,938,992 | 5/1960 | Crump | 219/528 |
| 3,047,701 | 7/1962 | Frungel | 219/213 |
| 3,349,359 | 10/1967 | Morey | 338/208 |
| 3,513,297 | 5/1970 | Jordan | 219/545 |
| 3,627,981 | 12/1971 | Kuhn | 219/212 |
| 3,900,624 | 8/1975 | Schare | 338/208 X |
| 4,144,445 | 3/1979 | Thweatt, Jr. | 219/532 |

FOREIGN PATENT DOCUMENTS

| | | |
|---|---|---|
| 1940439 | 6/1970 | Fed. Rep. of Germany . |
| 2919819 | 11/1980 | Fed. Rep. of Germany . |
| 3117247 | 11/1982 | Fed. Rep. of Germany . |

*Primary Examiner*—E. A. Goldberg
*Assistant Examiner*—Gerald E. Preston
*Attorney, Agent, or Firm*—Mandeville and Schweitzer

[57] ABSTRACT

A heating element for textiles is disclosed, which comprises a plane textile element and, combined with this, metal conductors, which can be connected to a source of electrical current and which oppose the electrical current flowing through them with a heat-producing resistance. As resistance elements, the conductors have metallic fibers or filaments with a denier like that of natural or synthetic textile fibers. The metallic fibers or filaments have an average cross sectional thickness of about 8 to about 24 microns.

19 Claims, 3 Drawing Figures

HEATING ELEMENT FOR TEXTILES

BACKGROUND OF THE INVENTION

The invention relates to a heating element for textiles, which comprises a plane textile element and, combined with this, metallic conductors, which can be connected to a source of electric power and which oppose the electrical current flowing through them with a heat-producing resistance.

This heating element is suitable for articles of clothing as well as for covers of upholstered seats. It can, however, also be used for other purposes, for example in conjunction with electric blankets.

Textile-elastic heating elements, which do not wear out and which are firmly combined with plane textile formations, are known. For instance, the German Offenlegungsschriften Nos. 2,919,819 and 3,172,247 describe an electroless, wet-chemical metallization of plane textile formations, so that these become electrically heatable. Such heating elements are not sensitive to crushing and bending actions occurring in practical use. With sensitive textiles, especially textiles with a nap such as pile materials or soft and hairy materials and the like, which are produced by napping, a wet-chemical treatment of the above described nature cannot be carried out, because the wet-chemical treatment in the full bath would also metallize the pile of pile materials. Through this, the nap or pile becomes discolored and also can no longer be insulated.

SUMMARY OF THE INVENTION

It is an object of the invention to provide an electrically heatable heating element for textiles which, without being too bulky in thickness, is firmly combined with a plane textile formation and not damaged by the bending and crushing which occurs in use. This heating element is intended preferably for voluminous textile materials such as pile materials or such materials, which have a nap.

This objective is accomplished inventively with a heating element of the initially mentioned type owing to the fact that the current-carrying metallic conductors, as resistance elements, have metallic fibers or filaments with a denier of natural or synthetic textile fibers. Such fibers or filaments are adequate for heating plane textile formations, but do not increase their thickness. On the contrary, they behave almost like textile fibers in practice and therefore do not noticeably change the natural behavior of textiles so finished while, on the other hand, they withstand all crushing and bending stresses.

An essential feature of the invention is therefore the construction of the current-carrying metallic resistance elements. For example, stainless steel, titanium, titanium alloy or nickel fibers or filaments, which can be produced in a denier corresponding to the denier of natural or synthetic textile fibers, are used as resistance elements.

Preferably, the diameter of these metallic fibers or filaments lies in the region of about 8 to about 24 microns, but the average diameter of the yarns or fibers is not strictly limited to this region.

Metal filaments of the said category are understood to be filaments of a finite length of about 1.5 m and above. The metal fibers, obtainable as metal fiber slivers, have a weight of 1 to 7 g per meter and a staple length of 50 to 250 mm.

The inventive resistance elements can be used as metal fiber slivers, as a metal fiber assemblage of finite length or in a yarn mixture with textile fibers, such as, for example aramide fibers, carbon fibers, polyester fibers, etc. The fibers can also be used in the form of a metal fiber fleece.

The essence of the invention lies in using, in combination with textiles of the aforementioned type, metallic resistance elements which, as a consequence of their very small diameter—in conjunction with their very high bending and crushing strengths—have a large surface area, so that their heat density is low. Known resistance heating elements with wire-shaped heating elements of relatively large diameter have the disadvantage that excessively high temperatures with the danger of short circuits can easily occur at the conductor, because the heat density is high here.

The metal fiber slivers, the metal fiber aggregates, the metal fiber yarn or the metal fiber fleece are to be insulated and brought into combination with the plane textile formation or material. This can be accomplished by braiding the metal fiber slivers, the filament aggregates or the yarn with polyester, polypropylene or other well insulating yarns or flat tapes. Heating elements, so prepared, are then sewn in undulating or meandering fashion onto the plane textile formation, for example, onto its reverse side.

A different type of combination of the inventive heating element with the textile material consists in that the metal fiber tape or the metal fiber yarns or the fleece is embedded in a soft, well-insulating elastomer, which can be processed as a brushable paste, but also as a foamable paste. Suitable elastomers are, for example, ethylene copolymer emulsions, polyurethane elastomers, silicone rubber, acrylonitrile-butadiene-styrene rubber, etc. To improve adhesion, a precoating with the coupling agent of the elastomer can, if necessary be provided on the textile material. The thickness of the elastomeric layer to be applied should amount to 0.2 to 0.5 mm after drying. The braiding around the metal fiber slivers or metal fiber yarn can also be combined with embedding in a foamed elastomer.

For textiles with a nap, such as pile materials, the pasty, elastomeric layer is applied on the side of the material opposite to the nap, that is, on the back side of the material.

According to a further characteristic feature of the invention, a heating element, which can be sewn to the textile material, is created by providing a metal yarn aggregate or a metal fiber aggregate of the aforementioned type, by the process of extrusion coating, with a sheath of a suitable elastomer such as silicone rubber, so that the metal filaments or metal fibers form the core of the heating element. Before the sheathing is applied by extrusion, the metal filament aggregate or metal fiber aggregate can be braided with insulating yarn such as polyester yarn.

The inventive heating elements are particularly suitable for being combined with soft and hairy textile materials with a corresponding dense and high pile. The heating element is worked into the pile, for example by sewing and in an undulating or meandering form or in some other configuration.

The arrangement of the inventive heating elements in a two-dimensional form has proven to be particularly advantageous for the distribution and rapid emission of heat. The yarn, formed from metal fibers or filaments, is processed here into a plane weave or mesh material, insulated and combined with the textile material to be heated. In producing the mesh material on the flat knitting machine with the built-in V system, it is advisable to knit the positive and negative power leads in the form of narrow strips along the two longitudinal edges of the rectangular mesh material. Metal fibers, 8 microns thick, are used for the mesh material and metal fibers, 22 microns thick, for the positive and negative power leads.

The heating element may moreover be constructed in the form of a thin fiber fleece. In this case, the fiber fleece is first of all combined with a thin, insulating plastic film of silicone rubber, polyurethane or polytetrafluoroethylene or a polyester flat weave and the like, in order to ensure its form stability. This composite is then combined with the textile material by way of an insulating intermediate layer of, for example, a polyurethane dispersion. The now form-stable metal fiber fleece is applied to this still moist layer by laminating.

A further possibility for the two-dimensional realization of the metal fiber heating element comprises converting the metal fibers into short pieces less than 1 mm in length and imprinting these in the form of a paste on the textile fabric. The paste consists here of an anionic antistat (e.g. BASOSOFT DA of B.A.S.F.), mixed with graphite and metal fibers cut into short pieces.

Mention should furthermore be made of the possibility of applying short metal fiber pieces in two-dimensional form on the textile fiber with the help of electrostatic flocking. The embedding layer, which carries the metal fiber layer, here forms the insulating layer for the textile material. It consists, for example, of silicone rubber, a polyurethane dispersion or the like. After the flocking procedure, the article, flocked with the metal fibers, is coated with a thin, insulating, plastic film or a polyester plane weave or flat knitted fabric.

The electrical heating of the inventive heating elements is accomplished in a known manner with direct current or alternating current in the low voltage region below 40 volts. The current can be taken from the public supply system with the usual 220 volt three-phase current with interpositioning of transformers and rectifiers by way of cable connection and plug or, in the case of cars, from the car's own accumulator by way of a cable connection and plug. Where such sources of current are not available, current can be taken from secondary batteries, for example nickel-cadmium batteries, several of which are connected in series in a carrier bag or even carried along in the article of clothing. With battery operation, the current supply is limited in time; however, rechargeable accumulators or batteries may be used.

The total heat output can be varied in a known manner by variously connecting several heating elements in parallel, in series or individually.

Textiles, which may be provided with the inventive heating element, are especially woven fabrics, knitted articles, knitted fabrics, fleeces, felts and voluminous materials, which are preferably provided with a nap, such as pile materials, or materials provided with a soft and hairy pile formed by napping, and suede-like synthetic fiber products, like those used nowadays in the clothing sector. Naturally tanned skins can of course also be equipped with the inventive heating elements.

Moreover, articles of clothing, such as jackets, parkas, overcoats, blousons, diver garments, vests, waist belts like those, for example, for motorcyclists and tractor drivers, gloves etc., as well as sleeping bags, electric blankets and the like can be equipped with the inventive heating elements.

The inventive heating elements are however also suitable for upholstered seat covers for trucks, tractors and passenger cars or in the area of the home for upholstered furniture covers. When used in trucks, it is not necessary, even if it is possible, to insert the heating conductors in the seat cushion itself. On the contrary, it suffices if an inventive heating element, arranged as an upholstery cover in the backrest region, is provided and connected over a cable and plug with the vehicle's own electrical system.

The invention is furthermore explained by means of example.

EXAMPLE 1

A metal fiber sliver of stainless steel, the individual fibers of which had a diameter of 8 microns, a weight of 1 g per linear meter and a staple length of about 250 mm, was provided with a false twist of 40 revolutions per meter and then braided immediately with polyester filament. Subsequently, an approximately 0.2 mm thick sheath of silicone rubber, SILICASTIC-GP-590 A/B of the Dow Corning Corporation, was applied by the extrusion process. Thereafter, the silicone rubber was vulcanized completely by heating it for 20 seconds at about 190° C. A 2 m long piece of fiber tape, so produced, was sewn in undulating fashion into the pile of a woven imitation fur, consisting of a cotton backing and an acrylic fiber pile. The heating conductor was connected over a cable and plug to a 12 volt car battery. By so doing, a current of 0.65 amps was made to flow through the heating conductor, as a result of which the temperature of the imitation woven fur was raised to 42° C.

EXAMPLE 2

A metal fiber sliver of stainless steel, the individual fibers of which had a diameter of 8 microns, a weight of 1 g per linear meter and a staple length of about 250 mm, was provided with a false twist of 40 revolutions per meter and then knitted on the flat knitting machine with a built-in V system (German Pat. No. 1,940,439) into a mesh material approx. 80 cm wide.

With the help of the V system, a 1 cm wide mesh tape was knitted along the longitudinal edges of the respective mesh material part. The thickness of the individual fibers of this mesh tape was 22 microns. The mesh tapes along the longitudinal sides of the mesh material part functioned as positive and negative leads for the current. A woven imitation fur, consisting of cotton backing and an acrylic fiber pile, was provided on its reverse side with a coating which has insulating properties, for example, a one-component polyurethane dispersion obtainable under the trade name of IMPRANIL DLN from the Bayer Co.

A fitted piece of metal fiber mesh material, on which the negative and positive leads for the current had been knitted, was placed on the woven imitation fur and joined to the impregnated reverse side, for example, by sewing with polyester filament yarn.

The still free upper side of the applied metal mesh material was insulated and covered by a twill weave or satin weave polyester fabric, which was sewn on with polyester filament yarn and functioned at the same time as the inner side of the lining.

The heating element, so formed, was connected to a 12 volt source of electric power, by means of which the woven imitation fur was heated to a temperature of about 42° C.

An example of the operation of the inventive heating element and a practical application of the same are shown schematically in the drawings.

Figure 1:
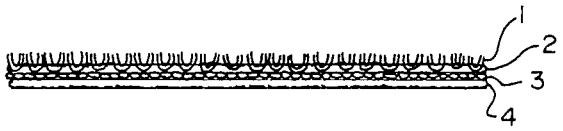
FIG. 1 shows a cross section through a pile material, which is equipped with the inventive heating element.

A width of pile material 1, on the back of which an electrically insulating layer 2 has been brushed, is shown in FIG. 1. On the back of this layer 2, there is a mesh material 3, which is knitted from a metal fiber yarn and which is shown in detail in FIGS. 2 and 3. This mesh material is covered by means of a width of lining 4, which, for example, is sewn on and may consist of polyester yarn.

Figure 2:
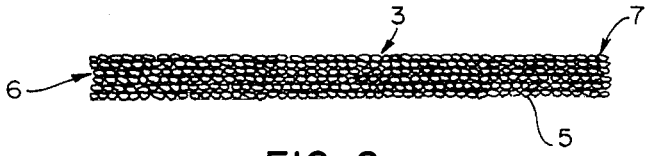
FIG. 2 is a partial plan view of an inventive heating element, which is constructed as a mesh material.
Figure 3:
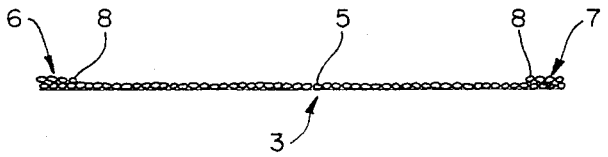
FIG. 3 is a front view of the heating element of FIG. 2.

FIGS. 2 and 3 show how the mesh material 3, forming the heating element, may be constructed. The width of mesh material 3 is knitted from a metal fiber yarn 5, whose individual metal fibers have a thickness of 8 microns.

Narrow strips 6 and 7 of metal fiber yarn 8, whose metal fibers have a thickness of 24 microns and are therefore thicker than the metal fibers of yarn 5 of the width of mesh material 3, are knitted on the rectangularly formed width of mesh material 3. These strips 6 and 7 function as positive and negative leads for the electrical current.

We claim:

1. A heating element for textiles comprising:
(a) a plane textile element,
(b) metallic conductors combined with said plate textile element and having metallic fibers and with a denier of natural or synthetic textile fibers and an average cross-section thickness of about 8 to 24 microns,
(c) said metallic conductors being resistance elements in that they are connectable to a source of electrical current and oppose electrical current flowing through them with a heat-producing resistance,
(d) said conductors being provided with an electrically-insulating sheath,
(e) said fibers behaving like textile fibers and therefore not noticeably changing the natural behavior of the textiles and withstanding crushing and bending stresses.

2. A heating element for textiles comprising:
(a) a plane textile element,
(b) metallic conductors combined with said plane textile element and having metallic filaments with a denier of natural or synthetic textile fibers and an average cross-sectional thickness of about 8 to 24 microns,
(c) said metallic conductors being resistance elements in that they are connectable to a source of electrical current and oppose electrical current flowing through them with a heat-producing resistance,
(d) said conductors being provided with an electrically-insulating sheath,
(e) said filaments behaving like textile fibers and therefore not noticeably changing the natural behavior of the textiles and withstanding crushing and bending stresses.

3. Heating element as defined in claim 1, wherein the metallic fibers have a staple length of about 50 to 200 mm.

4. Heating element as defined in claim 2, wherein the metallic filaments have a finite length of about 1.5 m or more.

5. Heating element as defined in claim 2, wherein the metal fibers or filaments have a weight per meter of about 1 to about 7 g.

6. Heating element as defined in claim 1, wherein the metallic fibers are a metal fiber sliver.

7. Heating element as defined in claim 2, wherein the metallic filaments are combined into yarns.

8. Heating element as defined in claim 1 wherein the metallic fibers have a weight per meter of about 7 g.

9. Heating element as defined in claims 1 or 2, wherein the sheath is a braid of textile fibers.

10. Heating element as defined in claims 1 or 2, wherein the sheath is formed from a textile yarn.

11. Heating element as defined in claims 1 or 2, wherein the sheath comprises an elastomer, in which the conductor is embedded.

12. Heating element as defined in one of the claims 1 or 2, wherein the conductors, which are provided with an electrically insulating sheath, are combined, in undulating or meandering form with a textile material such as a pile material.

13. Heating element as defined in one of the claims 1 or 2, wherein the conductors are provided in a flat weave or a in a single-layer mesh material, that is combined in an electrically insulating manner with the textile fabric to be heated.

14. Heating element as defined in claim 13, wherein narrow strips of conductor-containing material (8) are arranged at the two longitudinal edges of the rectangular flat weave or mesh material as positive and negative leads for the electrical current.

15. Heating element as defined in claim 14, wherein the narrow strips are knitted onto the mesh material.

16. Heating element as defined in claim 13, wherein the metallic fibers of the conductors have a lesser thickness in the flat weave or mesh material (3) than in the lateral strips.

17. Heating element as defined in one of the claims 1 or 2, wherein the metallic fibers form a thin fiber fleece, that is combined with a thin, electrically insulating support layer and is attached by means of an insulating intermediate layer to a textile material to be heated.

18. Heating element as defined in claim 1, wherein the metallic fibers have a length of less than 1 mm and are layered with a binder, which is processed as a paste, on a back side of the textile material which is to be heated.

19. Heating element as defined in claim 1, wherein the metallic fibers are flocked on an insulating layer, which is attached to a textile fabric to be heated and is covered with an insulating, flexible width of fabric.

* * * * *